United States Patent [19]

Hammelmann

[11] 4,285,469

[45] Aug. 25, 1981

[54] APPARATUS FOR CLEANING SURFACES HAVING AN UPRIGHT ORIENTATION

[76] Inventor: Paul Hammelmann, Zum Sundern 17, 4740 Oelde 1, Fed. Rep. of Germany

[21] Appl. No.: 92,949

[22] Filed: Nov. 9, 1979

[30] Foreign Application Priority Data

Nov. 11, 1978 [DE] Fed. Rep. of Germany ..... 2849079

[51] Int. Cl.[3] ..... B05B 3/18

[52] U.S. Cl. ..... 239/184; 137/413; 137/581; 137/899.1; 239/587

[58] Field of Search ..... 239/587, 148, 149, 178, 239/183, 184, 185; 137/899.1, 581, 413

[56] References Cited

U.S. PATENT DOCUMENTS

| | | | |
|---|---|---|---|
| 3,608,827 | 9/1971 | Kinkead | 239/184 |
| 4,182,493 | 1/1980 | Murray | 239/183 |

*Primary Examiner*—Richard A. Schacher

*Attorney, Agent, or Firm*—Michael J. Striker

[57] ABSTRACT

A water-spraying device for cleaning ship's hull and other upright surfaces has a horizontally movable carriage from which an outrigger extends towards the surface to be cleaned, and carries a water-spraying device. The carriage has a longitudinally extending water reservoir and a water supply conduit extends along its path of movement and has valves which are opening by a device in the carriage when the water in the reservoir drops below a predetermined level.

9 Claims, 4 Drawing Figures

APPARATUS FOR CLEANING SURFACES HAVING AN UPRIGHT ORIENTATION

BACKGROUND OF THE INVENTION

1. Field of the Invention

This invention relates to apparatus for treating upright surfaces, for example ship hulls, silo walls, oil storage tanks and the like, with cleansers (e.g., water, detergents) and conserving materials (e.g., paint).

2. The Prior Art

Structures of the type mentioned above are usually made of steel and their surfaces are therefore subject to damage from corrosion. To prevent this, these surfaces are coated with corrosion preventing media—such as paint or the like—which protect them. Before this can be done, however, the surfaces must be thoroughly cleaned—e.g., by washing—because otherwise the corrosion preventing media are not able to properly fulfill their intended purpose.

To manually effect such cleaning is extremely time-consuming, labor-intensive and hence costly. Equipment has therefore been developed for this purpose.

These devices have a carriage which travels horizontally along a support extending along the surface to be cleaned. For example, in the case of a ship.

The supply of water to these working devices is effected via water hoses, as is customary in many other types of applications also. However, in the kinds of applications with which the present invention is concerned, and particularly in dockyard use, the working conditions are very severe and such water hoses are subjected to an extraordinary degree of wear and/or accidental damage. As a result, frequent interruptions of the water supply are experienced, and since this means interruptions in the operation of the expensive surface cleaning equipment it reflects directly—and unfavorably—on the economy of operation. Especially in the case of dockyard operations, where the equipment is usually required to be able to travel the whole length of the dock, the shortest length possible for the water supply hoses is equal to half the length of the dock. Hoses of such length are difficult to handle and their replacement with new ones in the event of damage requires a relatively long time, during which the personnel manning the cleaning equipment can only stand idly by and watch.

SUMMARY OF THE INVENTION

Accordingly, it is a general object of the present invention to avoid the prior art disadvantages.

A more particular object is to provide an apparatus of the type under discussion, which requires no water supply hoses.

A concomitant object is to provide such an apparatus as mentioned above, which is relatively simple in construction and hence relatively inexpensive to manufacture.

In pursuance of the above objects, and still others which will become apparent hereafter, one aspect of the invention resides in an apparatus for cleaning upright surfaces. Briefly stated, such apparatus may comprise an elongated carriage movable horizontally along a support having an upright wall; a multi-partite pivotable arm projecting from the carriage and having a free end position provided with a water-discharging device; a reservoir mounted on and extending along the carriage so as to be located laterally adjacent the wall, the reservoir having an upper portion provided with a water inlet opening which is located at a side facing the wall and is substantially coextensive with the length of the reservoir; a water supply conduit mounted at the wall extending along the path of movement of the carriage and having a plurality of longitudinally spaced water discharge valves positioned to discharge water through the inlet opening into the reservoir; and means responsive to the water level in the reservoir for opening the valves during movement of the reservoir when the water level therein drops below a predetermined lower limit.

According to a particularly advantageous embodiment of the invention, the water reservoir has a length corresponding to substantially the entire length of the apparatus itself. In any event, however, the volumetric capacity of the reservoir must be sufficiently large to supply the water requirements which occur during travel of the apparatus between the supply locations (taps) less the length of the apparatus. Water is discharged into the reservoir from a respective tap during movement of the apparatus (and washing of the respective surface) until the maximum filling level of the reservoir is reached. At that time the control equipment of the apparatus releases an actuating member of the tap so that the latter can close. Of course, the control functions could be effected electrically or electronically, rather than mechanically.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
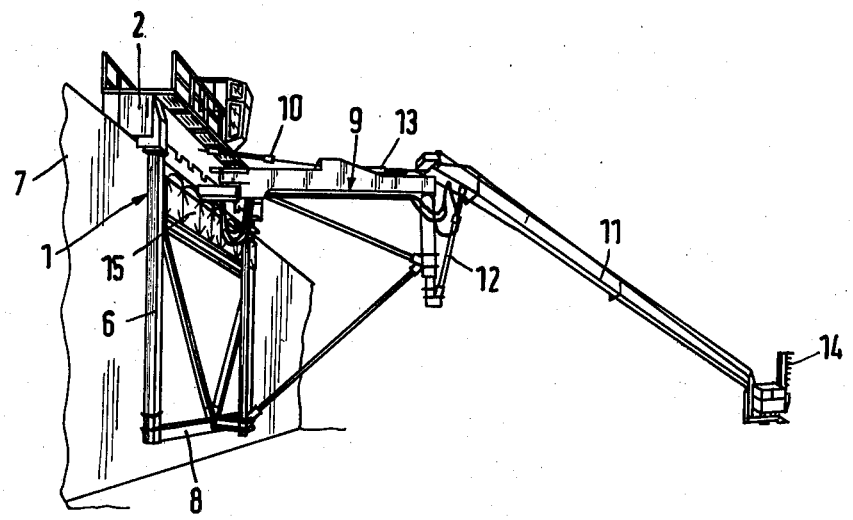
FIG. 1 is a perspective view illustrating an apparatus embodying the invention.
Figure 2:
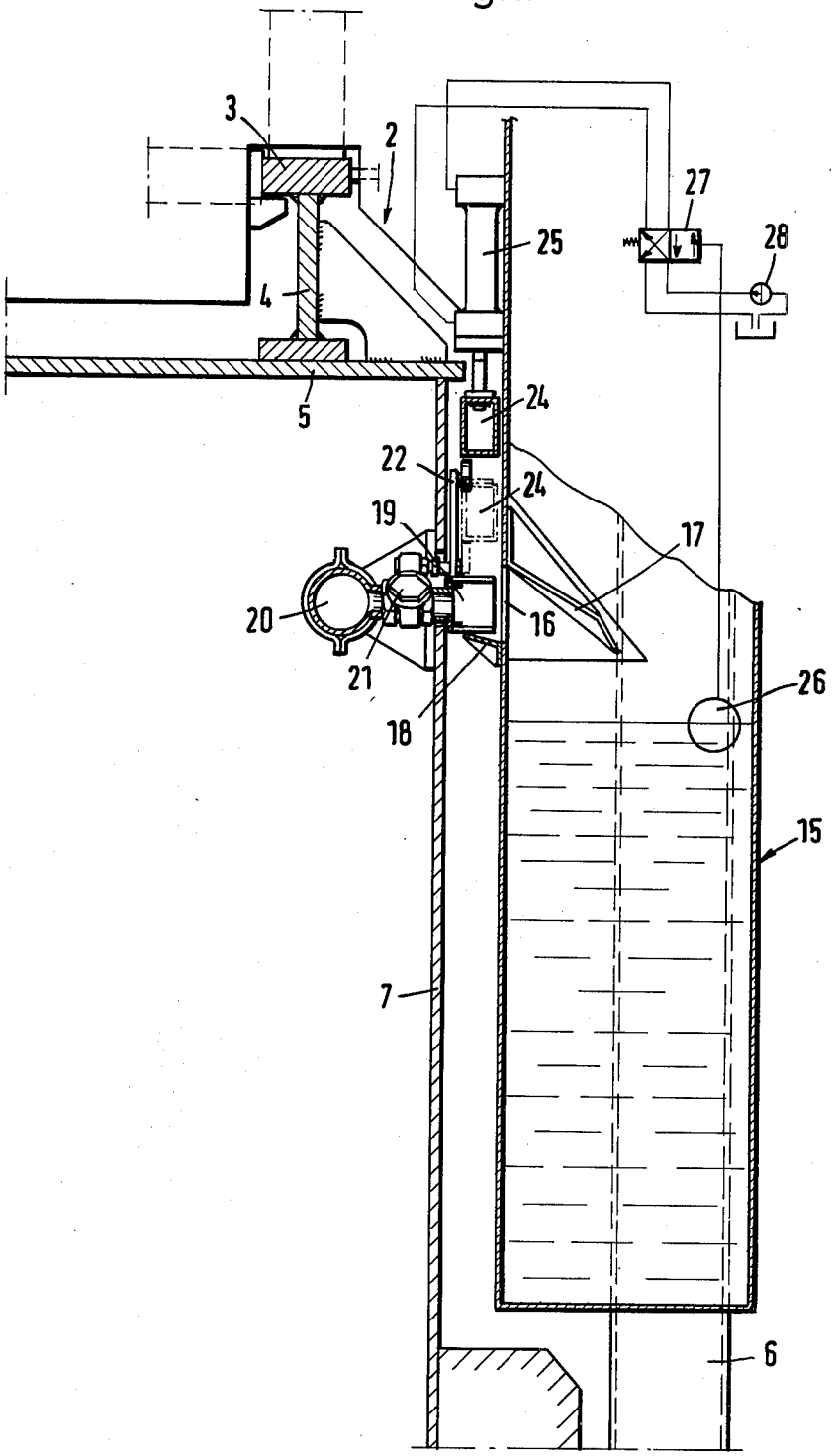
FIG. 2 is a vertical section, in somewhat diagrammatic form, through an upper part of the apparatus in FIG. 1.
Figure 3:
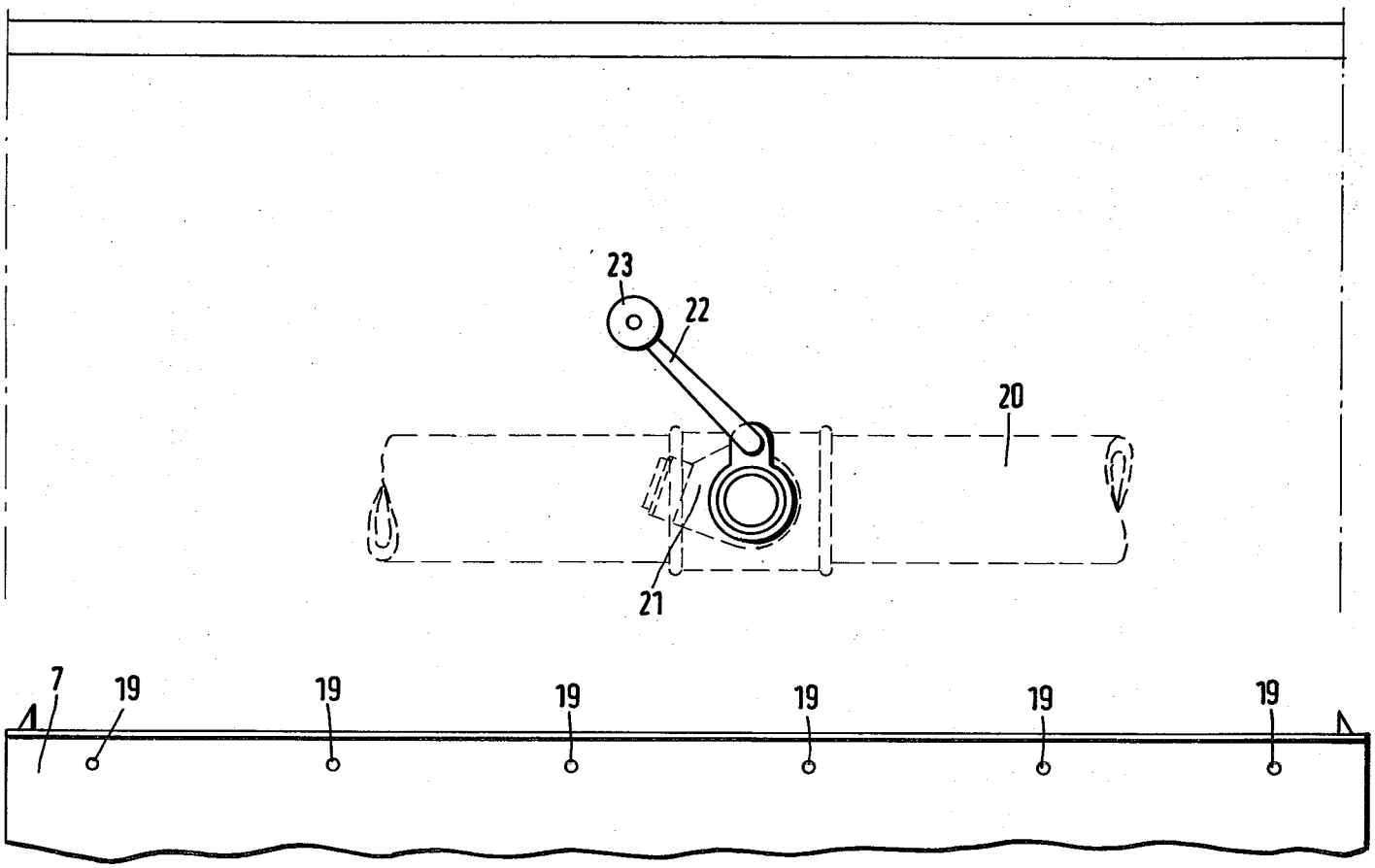
FIG. 3 is a diagrammatic view, showing details of the apparatus in FIGS. 1 and 2.

The apparatus illustrated in FIGS. 1–3 has a carriage 1 which is of generally L-shaped configuration and has an upper horizontal part 2 mounted for movement along a rail 3 and a T-beam 4 (FIG. 2), both of which are—in the particular illustrated embodiment—mounted on a dock wall 7. The T-beam 4 is, in particular, anchored along the upper edge 5 of the wall 7. Rollers associated with the end regions of the part 2 cooperate (engage) with the rail 3 and the beam 4. The carriage 1 also has a vertically oriented frame-shaped part 6 which extends adjacent and parallel to the dock wall 7 and has rollers journalled in its lower horizontal frame member 8, by means of which it engages the wall 7.

An outrigger arm 9 is connected to the carriage 1 so as to be turnable about a vertical pivot axis through a maximum angle of 180°. Arm 9 is also of frame construction and in sideview it is of trapezoidal shape. Cylinder-and-piston units 10 (e.g., hydraulically operated ones) are articulately connected at their opposite ends to the carriage 1 and the arm 9, respectively, so as to effect pivoting of the arm when desired.

A mast 11 is mounted on the arm 9 so as to be pivotable with reference to the same about a horizontal as well as a vertical axis. Pivoting about the horizontal axis is effected via cylinder-and-piston units 12 similar to the units 10; other units 13, also similar to the units 10 and 12, effect pivoting about the vertical axis. The free end of mast 14 carries a working device 14, which may be composed of one or more high-pressure spray tubes provided with nozzles for directing high-velocity sprays of water against a surface to be cleaned.

A water reservoir 15 is mounted on the carriage part 6 and has a length which advantageously corresponds to substantially the entire length of the apparatus (i.e., as seen in FIGS. 1 and 2 in direction normal to the plane of the drawings). On its side facing towards the wall 7 the reservoir 15 has a water inlet opening 16 which here is rectangular and extends over almost the entire length of the reservoir 15. A baffle 17 is mounted above the upper edge of the opening 16 and is inclined inwardly and downwardly relative to the reservoir 15, so that water impinging the baffle 17 is directed into the reservoir. A second baffle 18 is mounted along the lower edge of the opening 16; it is located outside the reservoir and inclined upwardly and in direction towards the wall 7, so as to extend beneath the discharge pipes 19 provided at the taps of the water supply conduit 20.

The conduit 20 is located at the level of the opening 16 and mounted behind the wall 7 so as to be protected by the wall against possible damage. It has a plurality of taps uniformly spaced over its length and each composed of a discharge valve 21 and an associated one of the pipes 19. The valves 21 themselves are also located behind the wall 7 for protection, and only the pipes 19 extend through openings in the wall so that their outlets are located above the baffle 18.

Each of the valves 21 has a closure member which is coupled to a pivotable actuating arm 22 (FIG. 3). In the illustrated embodiment each of these arms (one shown) carries at its free end a freely turnable contact roll 23 which is located within the dock (i.e., at the side of wall 7 where the reservoir 15 is) so that it can be engaged by a contact member 24 of a control that is mounted on and moves with, the carriage 1. The arm 22 is shown in FIGS. 2 and 3 in the position which it assumes when the valve closure member closes the valve to prevent outflow of water. A cylinder-and-piston unit 25 of the double-acting type is connected to the member 24 and can move the latter between the full-line (inactive) and broken-line (active) positions shown in FIG. 2. In the active position the member 24—moving with the carriage 1—abuts roll 23 and via the same pivots the arm 22 to the position shown in broken lines in FIG. 2, i.e., to a position in which the closure member of the respective valve 21 is in open position so that water is discharged via the associated pipe 19 and opening 16 into the reservoir 15.

The reservoir itself is provided with a level control 26 (e.g., a conventional floating-ball device) coupled to a multi-way valve 27 which it controls. Depending upon the setting of the valve 27, hydraulic fluid is forwarded from a supply by pump 28 into one or the other cylinder chamber of the double-acting cylinder-and-piston unit 25, so that the same either raises or lowers the member 24. Thus, when the highest permissible water level has been reached in the reservoir 15, the device 26 switches the valve 27 to a position in which the fluid supplied by pump 28 enters that cylinder space of unit 25 which causes the unit 25 to lift (retract) the member 24 out of engagement with the arm 22. The latter which may e.g., be spring-loaded, then returns to its full-line position (FIG. 3) in which the closure member of the valve 21 prevents further outflow of water.

The volumetric capacity of the reservoir 15 is so selected that there is at least sufficient water present at all times to allow the apparatus to function at full water-spraying operation during the time required for the apparatus to traverse the distance (lengthwise of wall 1) between two consecutive taps, less the length of the apparatus itself. In other words: there must be sufficient water in the reservoir for the later never to run dry before refilling begins, even when the equipment operates at maximum water output against a surface being cleaned.

Figure 4:
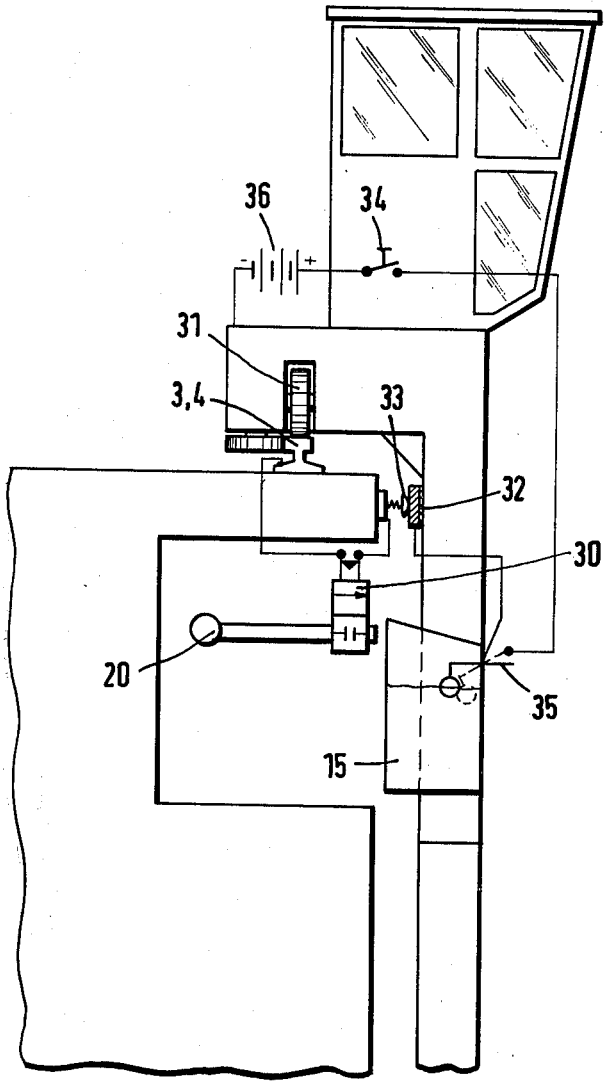
FIG. 4 is a diagrammatic illustration of an electric control circuit for use with the apparatus in FIG. 1.

The embodiment of FIGS. 1–3 has a mechanical control for the water inlet valves 21. However, an electrical control can be used instead, as is shown in FIG. 4. In all other respects, the embodiment of FIG. 4 is the same as the preceding one.

In FIG. 4 the water inlet valves 30 (one shown) are electromagnetic valves; they are arranged in the same manner as the valves 21 described with reference to FIGS. 1–3. Negative polarity for the valve 30 is supplied via the rail 3 and beam 4 which in turn are electrically connected with the negative pole of the energy supply 36 by means of movable contacts, here in form of contact rollers 31. A bus bar 32 is mounted on the carriage 1 electrically insulated therefrom; it extends over the entire length of the reservoir 15 and cooperates with a slip contact 33 which is in conductive engagement with it.

A switch 34 initiates operation of the filling process and a further switch 35—interposed in the electrical circuit energized by supply 36 and float-controlled in known-per-se manner—operates to prevent overfilling of the reservoir 15. Thus, water can be discharged into the reservoir from the conduit 20 only when the switch 34 is operated, the switch 35 is closed and the contact 33 is in conductive engagement with bus bar 32, all at the same time.

While the invention has been illustrated and described as embodied in an apparatus for cleaning surfaces having an upright orientation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Apparatus for cleaning surfaces having an upright orientation, particularly ship hulls, comprising an elongated carriage movable horizontally along a support having an upright wall; a multi-partite pivotable arm projecting from said carriage and having a free end portion provided with a water-discharging device; a reservoir mounted on and extending along said carriage so as to be located laterally adjacent said wall, said reservoir having an upper portion provided with a water inlet opening which is located at a side facing said wall and is substantially coextensive with the length of said reservoir; a water supply conduit mounted at said wall extending along the path of movement of said carriage and having a plurality of longitudinally spaced water discharge valves positioned to discharge water through said inlet opening into the reservoir; and means responsive to the water level in the reservoir for opening said valves during movement of the reservoir when the water level therein drops below a predetermined lower limit.

2. Apparatus as defined in claim 1, wherein the length of said reservoir is substantially coextensive with the length of said carriage.

3. Apparatus as defined in claim 1, said water supply conduit and said valves being located behind said wall at one side thereof remote from said reservoir, and each of said valves having a discharge pipe and a valve-controlling element located at another side of said wall and adjacent said reservoir.

4. Apparatus as defined in claim 3, said valve control elements being pivotable arms movable to and from a position in which the respective valve is open; and wherein said means comprises an element engageable with the respective arm for moving the same to said position, and a cylinder-and-piston unit connected to said element for displacing the same into and out of a location in which it can engage the respective arm.

5. Apparatus as defined in claim 4, said cylinder-and-piston unit having a double-acting cylinder provided with two cylinder chambers, and said means further comprising a pump for supplying hydraulic fluid, a valve movable between two positions in which it passes the fluid to different ones of said chambers, and a device responsive to the level of water in the reservoir for moving said valve to a respective one of said positions.

6. Apparatus as defined in claim 3, each of said valve-controlling elements being a pivotable arm and having a free end portion provided with a roll.

7. Apparatus as defined in claim 1; and further comprising a baffle mounted above said inlet opening and extending inwardly of said reservoir at a downward inclination relative to said inlet opening, so as to prevent water splashing outwardly through said inlet opening.

8. Apparatus as defined in claim 7; and further comprising another baffle mounted adjacent a lower edge of said inlet opening end extending therefrom toward said wall at an upward inclination but below said discharge valves, so as to direct water from said valves through said inlet opening into said reservoir.

9. Apparatus as defined in claim 1, said valves being electromagnetic valves, said carriage including a longitudinally extending bus bar; and further comprising an electrical supply circuit, including a slide contact extending from said wall into conductive engagement with said bus bar, and a water-level controlled switch interposed in said circuit and adapted to interrupt the same when the water level in the reservoir reaches a predetermined upper limit.

* * * * *